US006033320A

United States Patent [19]

Bamberger

[11] Patent Number: 6,033,320

[45] Date of Patent: Mar. 7, 2000

[54] UTILITY GOLF CLUB

[76] Inventor: Michael Bamberger, 7003 Lincoln Dr., Philadelphia, Pa. 19119

[21] Appl. No.: 09/106,802

[22] Filed: Jun. 29, 1998

[51] Int. Cl.[7] ..... A63B 53/04

[52] U.S. Cl. ..... 473/314; 473/324; 473/349; 473/291

[58] Field of Search ..... 473/314, 318, 473/319, 320, 289, 328, 287, 290, 291, 345, 349, 292, 324

[56] References Cited

U.S. PATENT DOCUMENTS

| | | | |
|---|---|---|---|
| 2,491,383 | 12/1949 | Liolich | 273/77 |
| 3,077,350 | 2/1963 | Koorland | 273/164 |
| 3,416,797 | 12/1968 | Pfau | 473/292 X |
| 4,896,885 | 1/1990 | Kajita et al. | 273/167 |
| 5,228,688 | 7/1993 | Davis | 473/290 X |
| 5,294,122 | 3/1994 | Longo | 273/162 |
| 5,460,371 | 10/1995 | Takeda | 273/80.2 |
| 5,616,086 | 4/1997 | Chappell | 473/290 |
| 5,624,329 | 4/1997 | Schneebeli | 473/287 |
| 5,643,102 | 7/1997 | Hsien | 473/290 |
| 5,746,666 | 5/1998 | Lovett | 473/328 |

OTHER PUBLICATIONS

Golf Digest, Equipment, Aug. 1979 (1 pg.).
Photograph of Tiger Woods, undated.
Golf Magazine, Apr. 1998, p. 181.
Specification of the new Taylor Made Rescue golf club from the Talor Made Golf web site, Jun. 1999.

*Primary Examiner*—Kien T. Nguyen
*Attorney, Agent, or Firm*—Wood, Herron & Evans, L.L.P.

[57] ABSTRACT

A utility golf club including a shaft having a grip at a first end and a metal wood-type head at the second end. The golf club has a length which is typical for putters and the metal wood-type head has a weight which is also typical of many putters. The lie or angle between the shaft and horizontal is upright and the angle of the front face of the head is generally similar to typical wood clubs, such as the number 3 through 5 woods. The golf club may be used with a familiar putting stroke from a variety of positions on the golf course to achieve chip shots, bump-and-run shots, sand shots and trouble shots.

28 Claims, 5 Drawing Sheets

UTILITY GOLF CLUB

FIELD OF THE INVENTION

The present invention generally relates to golf clubs and, more specifically, to golf clubs used for shots such as trouble shots, sand shots, chip shots or so-called bump-and-run shots.

BACKGROUND OF THE INVENTION

Current regulations call for a maximum of fourteen golf clubs to be used by a golfer during a round of golf. Typically, a set of clubs includes a series of three or four woods, which are typically used for the longest distance shots and which may be formed of various materials, including wood, metal, ceramic or composite materials. Other clubs include irons which range from relatively low lofted irons, such as 1 or 2 irons used for longer distance shots to relatively high lofted irons, such as wedges which are typically used for shorter shots. A regulation set of golf clubs includes a putter for the final shots taken on or around a putting green.

Often, chip shots, trouble shots, bump-and-run shots and sand shots around the green require improvisation on the part of the golfer. That is, these shots may require a golfer to use a standard wood, iron, or putter in a manner that is not typical for that club. As an example, a golfer may find his or her ball among trees and, therefore, may desire to play a low running shot. This often requires the use of a lower lofted club, such as a 2 or 3-iron and typically also requires a unique grip, stance, and swing not normally taken with a low-lofted club. This shot is difficult for the average golfer. As additional examples, short chips or longer bump-and-run shots may be attempted by the average golfer using lower or medium lofted irons or woods. Again, these shots are difficult for many golfers to execute. Many golfers have particular trouble hitting the golf ball from greenside sand traps because direct contact with the ball is generally undesirable. For this reason, average golfers are not comfortable making the necessary swing in a sand trap.

As briefly mentioned above, various manners of using standard golf clubs have been developed to address particularly unique lies or situations on the golf course. One manner of chipping the ball around the green which is becoming more popular is the use of a 3-wood or 4-wood gripped severely down on the shaft by the golfer. This shot may be well executed by golf professionals. However, these shots are difficult for the average golfer because of the length of the shaft, which is generally 41 inches or more, and the awkward feel of the club particularly wit the light club head weight and the flat lie of the club.

Chipper clubs have been developed for hitting the ball onto the green from close range. These clubs look and feel much like putters, except that they have severely inclined front faces, often with the loft of about an 8-iron. Other chippers have been used in the past and have a length similar to a putter, but a blade resembling an iron. Once again, the use of these clubs is limited and difficult. Thus, such chippers have not become widely accepted and used by golfers of all abilities.

It would therefore be desirable to provide a golf club which may be used in a wide variety of situations in the fairway, around the green, within sand traps, and to execute trouble shots, such as those around trees.

SUMMARY OF THE INVENTION

The present invention therefore provides a utility golf club generally including a shaft having a first end and a second end defined along an axis, and a grip portion extending downwardly from the first end. A head, which preferably has the shape and general dimensions of a wood head, such as a 4-wood or 5-wood, is connected to the second end of the shaft. Specifically, the head has a top surface, a bottom surface, a rearwardly angled front face portion and a generally rounded periphery extending from the front face portion. In the manner of a typical wood head, the top and bottom surfaces each have a surface area greater than the front face portion. More specifically, the top surface is preferably rounded and the bottom surface preferably includes at least one generally flat portion. In further accordance with the invention, the golf club has a length, weight, and feel comparable to a typical putter. Specifically, the length as measured from the first end of the shaft to the bottom surface of the head is preferably less than about 39 inches. Also, the club has an upright lie in that the angle generally formed between the bottom surface of the metal head and the shaft axis is greater than about 65°. Based on this combination of features, for example, the length and lie of the club will be very familiar to the golfer as one corresponding generally to their putter. For this reason, a typical pendulum-like putting stroke may be taken with this club for any given shot, such as a chip, bump-and-run shot, sand shot, or trouble shot. Golfers generally feel much more comfortable using a simple putting stroke than using a conventional swing that requires the wrists to break and requires more precise timing and hand/eye coordination. Also, because the head of the club is shaped like a wood club head, the club is more versatile and the margin for error in the swing is much larger than for other clubs.

In the preferred embodiment of the invention, the front face portion has a loft or face angle comparable to a typical wood club, such as a 3-wood, 4-wood or 5-wood. In the most preferred embodiment, the front face is angled from vertical at least 10° and preferably in a range between about 16° and about 22°. The length of the club is preferably about 35 inches, which is a standard length for a putter. Also, the preferred angle between horizontal, on generally the bottom surface of the club head at address, and the shaft axis is greater than about 70° and most preferably about 72°. In this regard, "horizontal" may be generally defined as the bottom surface of the club head when disposed in a normal address position. In further accordance with the invention, the weight of the club head is greater than about 230 grams, and preferably closer to 290 grams, which is approximately the club head weight for a putter and considerably greater than the club head weight of a conventional fairway wood. For this reason, the club should feel very familiar to the average golfer when used with a putter swinging style. The increased weight will also assist in moving the club through impact and therefore result in more solid and consistent hits.

Also in accordance with the invention, the front face portion of the club head is offset rearwardly with respect to the shaft axis in a manner similar to a putter, to again make the club look and feel comparable to a putter. This offset also provides a better sight line to the ball for the golfer and assists with getting the golf ball slightly airborne. Finally, the club head is preferably a metal wood-type head having a conventional hollow metal construction.

In accordance with the description above, and the more particular description to be given herein, it will be appreciated that the present invention allows a single club to be used effectively by the average golfer in a wide variety of situations. The familiar length and weight of the club, being comparable to many putters, allows the typical golfer to take a very conventional and familiar putter stance and putter swing when using the club. The speed of the swing will dictate the length of the shot in a predictable manner. The shape of the club head, being similar to a typical wood head, glides through and/or along grass, sand, or even hard dirt surfaces more easily and consistently than an iron when used by golfers of all abilities.

These advantages, as well as other advantages of the invention will become more readily apparent upon review of the following detailed description, taken in conjunction with the accompanying drawings.

DETAILED DESCRIPTION OF THE PREFERRED EMBODIMENT

Figure 1:
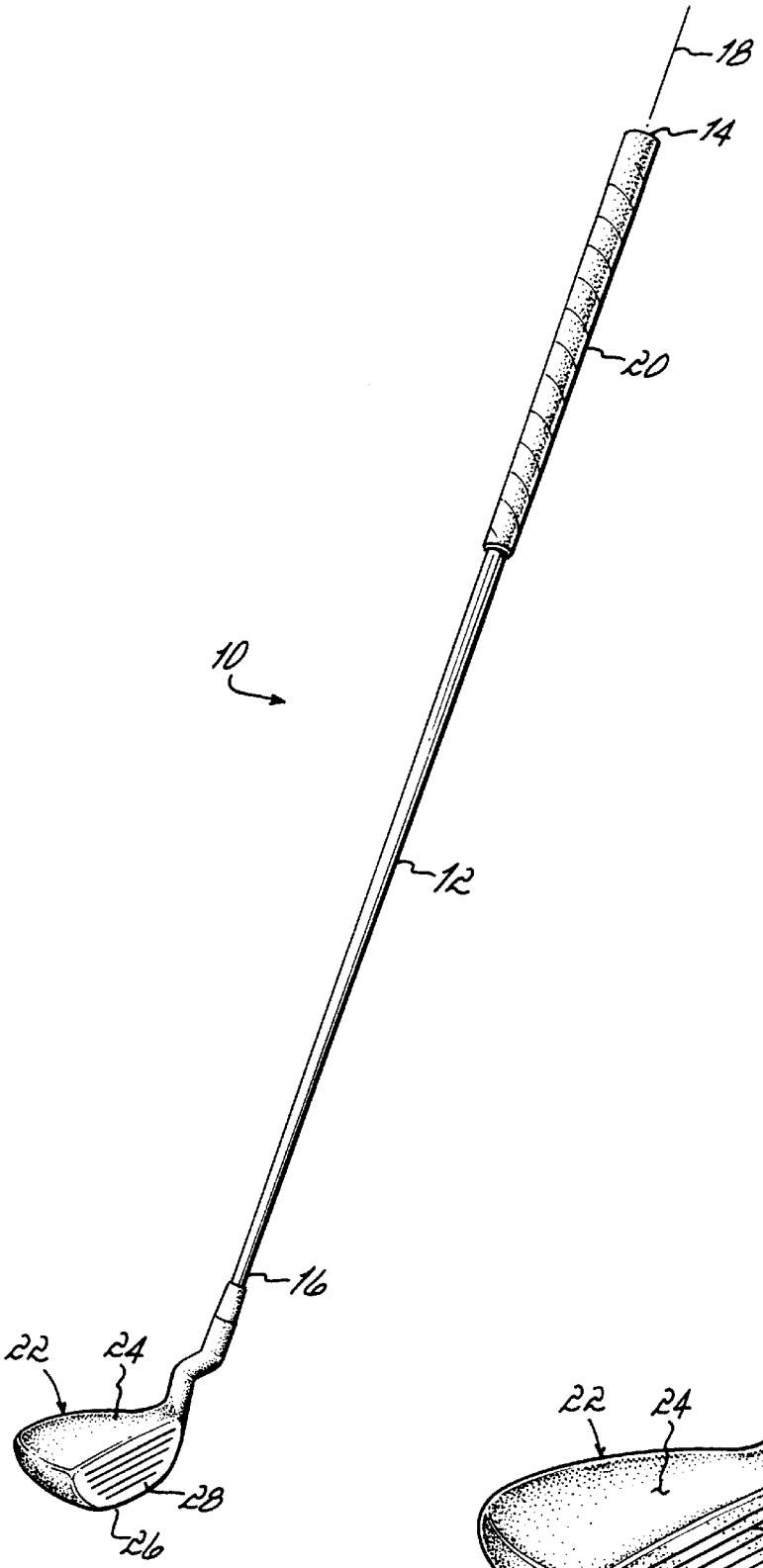
FIG. 1 is a perspective view of a utility golf club constructed in accordance with the invention.
Figure 2:
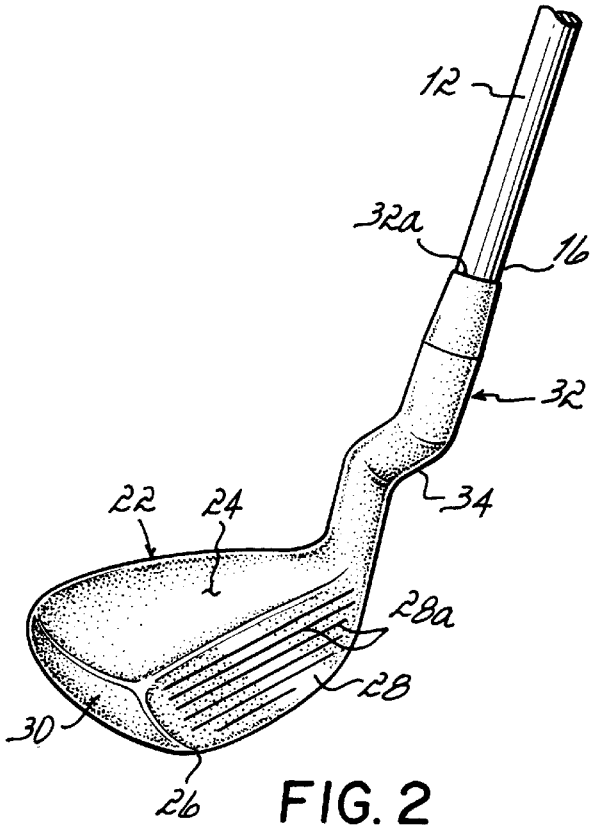
FIG. 2 is an enlarged perspective view of the club head shown in FIG. 1.
Figure 3:
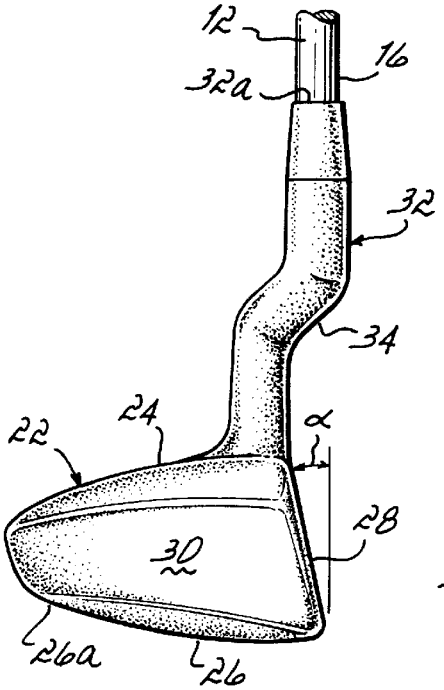
FIG. 3 is an enlarged side elevational view of the club head shown in FIGS. 1 and 2.
Figure 4:
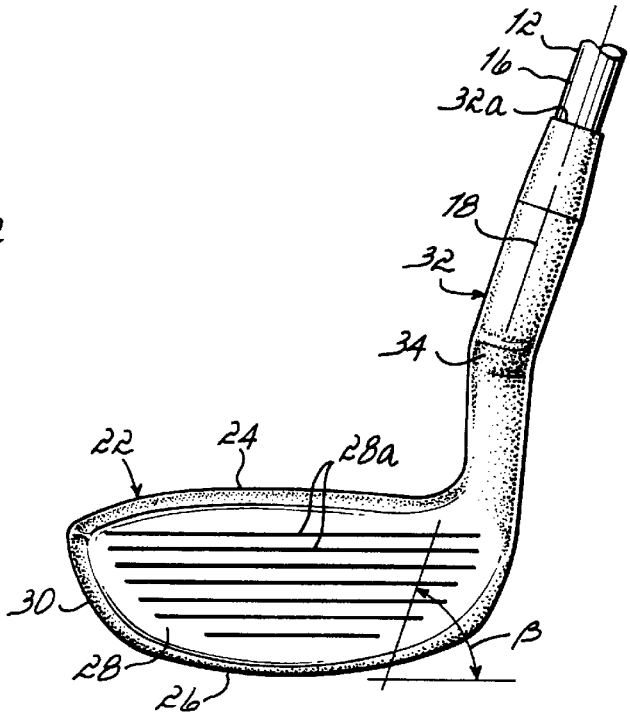
FIG. 4 is an enlarged front view of the club head shown in FIGS. 1–3.
Figure 5:
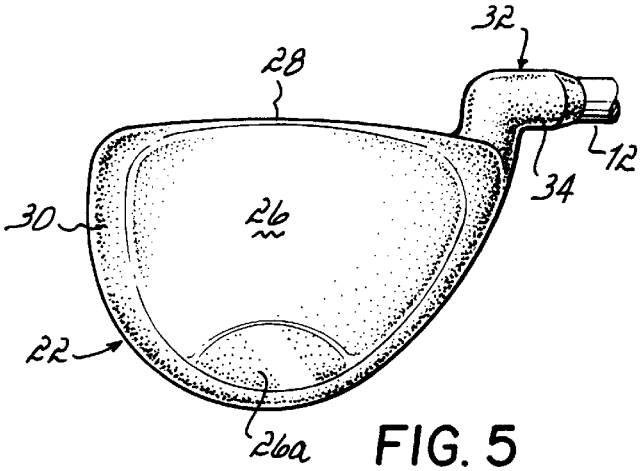
FIG. 5 is a bottom view of the club head shown in FIGS. 1–4.

FIGS. 1–5 illustrate one preferred embodiment of the utility golf club of this invention. It will be appreciated that the various aspects of this invention may be combined and constructed in various ways while still achieving the benefits encompassed within the spirit and scope of the invention. As specifically shown in FIG. 1, golf club 10 comprises a shaft 12 having a first end 14 and a second end 16 defined along an axis 18. A grip 20 extends downwardly from first end 14. A head 22 is connected at second end 16. As better shown in FIGS. 2–5, head 22 is shaped similar to a wood head, such as a 4-wood or 5-wood. In this regard, head 22 includes a generally rounded top surface 24, a generally flat bottom surface 26 (i.e., similar to a fairway wood), a rearwardly inclined front face portion 28, which may have conventional score lines 28*a*, and a rounded periphery 30 extending from the front face portion 28. One example of a bottom surface configuration is shown in FIG. 5. This configuration includes a distinct flat portion 26*a* at the rear of surface 26. The remainder of surface 26 is generally flat with a slight convex curvature from right to left or heel to toe as viewed in FIG. 5. It will be understood that other types of generally flat bottom surface configurations, such as are typically used for woods, may be used in practicing this invention as well. A hosel portion 32 may extend upwardly from top surface 24 and may include an offset portion 34 as shown best in FIG. 3. It will be understood that this offset may be of varying degrees according to the preferences of the user. Hosel portion 32 includes an attachment opening 32*a* for receiving lower end 16 of shaft 12. The distance between first end 14 and bottom surface 26 of club head 22 is preferably less than about 39 inches and, more preferably, about equal to the standard length of a putter which averages about 35 inches.

Referring more specifically to FIGS. 3 and 4, the preferred angle $\alpha$ of front face portion 28 relative to vertical is between about 10° and about 25°. A more optimum range to achieve a wide variety of shots has been found to be between about 16° and about 22° when club head 22 has the general shape and dimensions of a 5-wood. The object of this face angle is to minimize air time of the ball after impact relative to each of the variety of shots that may be made with club 10. As further shown in FIG. 4, an angle $\beta$ defined generally between bottom surface 26 of club head 22 and shaft axis 18 is an upright angle, similar to many putters. This angle is often referred to as the "lie" of the club. In accordance with an aspect of the invention, the lie of the club, or angle $\beta$, is preferably greater than about 65° and more preferably closer to 72°.

Club head 22 may be formed from lost wax casting techniques typically used for hollow club heads, such as metal wood heads. One main difference between typical metal wood heads and club head 22 is that the weight of club head 22 is more closely comparable to the weight of a putter head and up to about twice the weight of a conventional fairway wood head. In this regard, while club head 22 may be hollow, its top, bottom and front face wall thicknesses have been increased to increase the overall weight of head 22. The weight may be evenly distributed, however, golf club 10 is constructed to concentrate more weight at hosel 32. If desired, this may be compensated with additional weight in the toe region of golf club 10. Also, weight may be appropriately distributed top to bottom to alternatively raise or lower the club head center of gravity and correspondingly promote lower or higher ball flight. The club head weight is preferably greater than about 230 grams and more preferably within the range of 230 grams to about 350 grams. The currently preferred head weight is about 290 grams. When a hollow metal head construction is used, the head may or may not be filled with a curable foam using a typical metal wood construction technique. Of course, other hollow or solid head constructions and materials may be used as well, while still retaining the general shape of a wood head.

Figure 6:
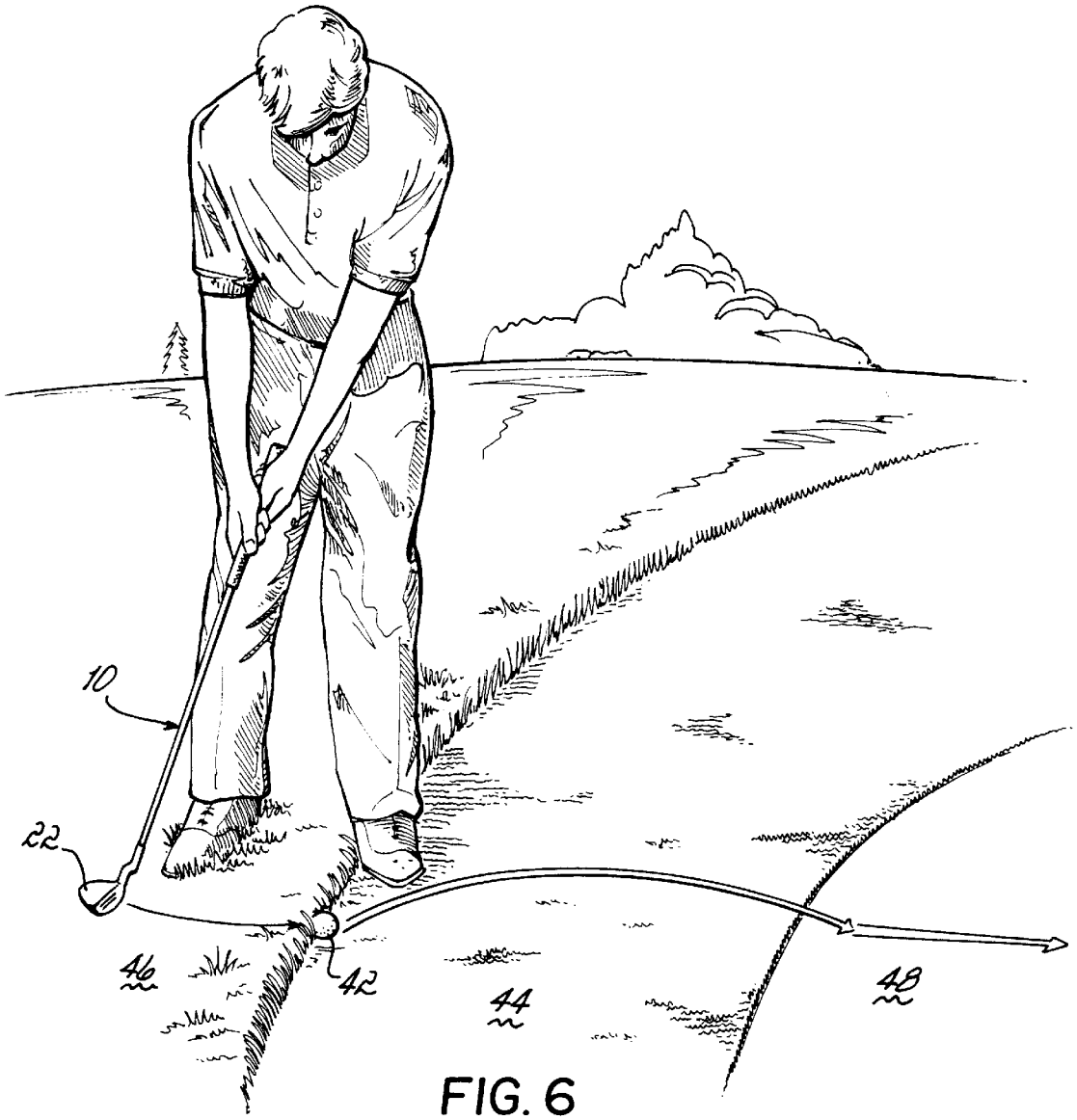
FIG. 6 is a perspective view of a golfer using the utility golf club of the present invention during a short chip around a putting green.

As mentioned herein, golf club 10 may be effectively used in a wide variety of situations by the average golfer. Some of the situations which may particularly benefit from golf club 10 are illustrated in FIGS. 6–9. It will be appreciated that many other uses of club 10 exist as well. FIG. 6 illustrates a golfer 40 hitting a golf ball 42 from a greenside location at the junction of fringe 44 and rough 46. As is known to many golfers, because of the difference between the short grass of fringe 44 and the longer grass of rough 46, this shot is particularly troublesome. Using golf club 10, and a typical putting stroke, ball 42 may be effectively struck from this location onto the putting green 48. Head 22 will glide more easily through the longer grass of rough 46 than a typical iron. Moreover, while golfer 40 may have a standard wood club in his or her set to use from this location, it would feel more awkward and cumbersome than golf club 10. Therefore, the golfer 40 would be more likely to mishit the shot with either a typical iron or wood club. Of course, club 10 may also be effectively used to chip the ball from other more or less favorable greenside lies.

Figure 7:
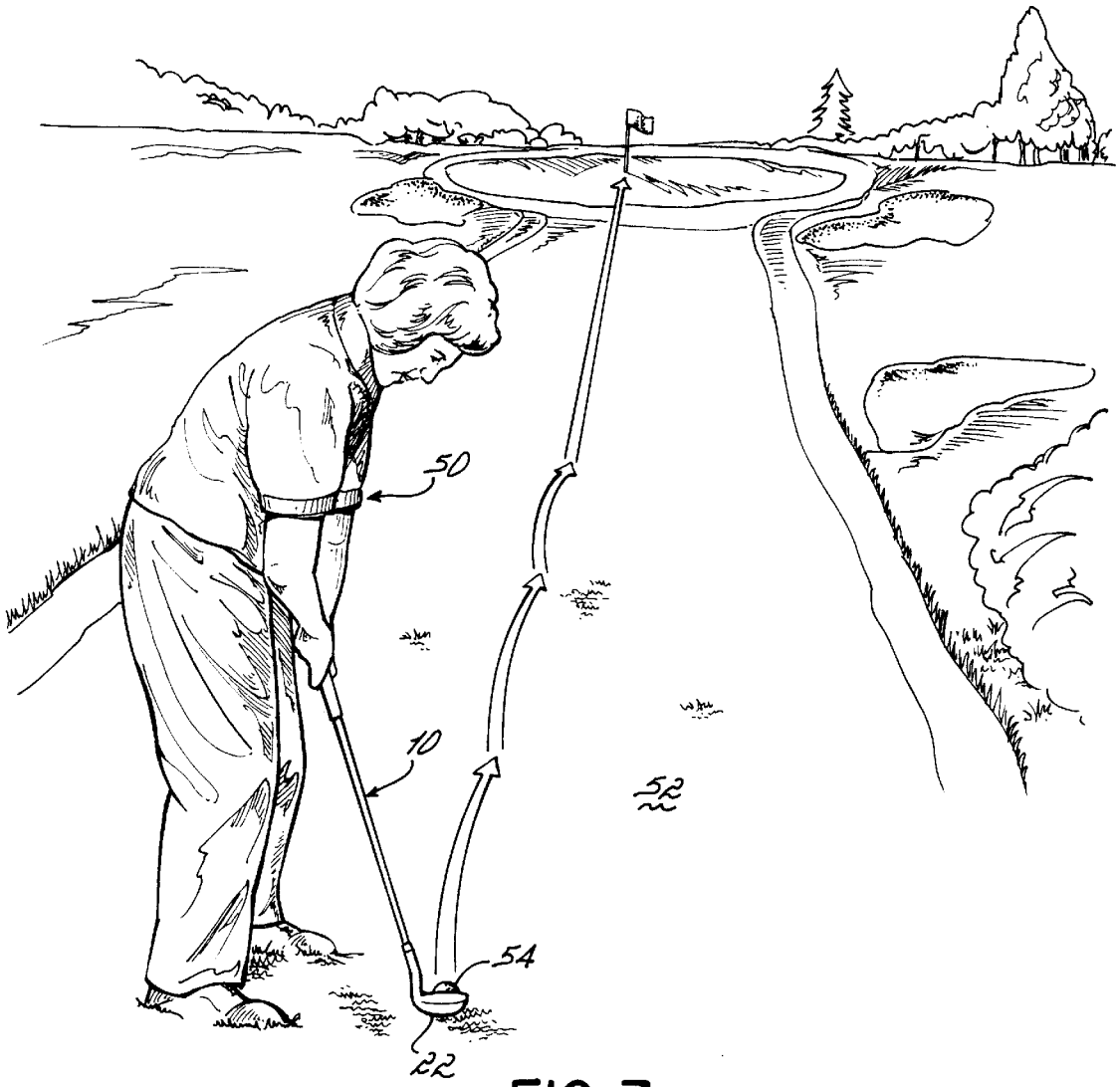
FIG. 7 is a perspective view of a golfer using the utility golf club of this invention to perform a bump-and-run shot.
Figure 9:
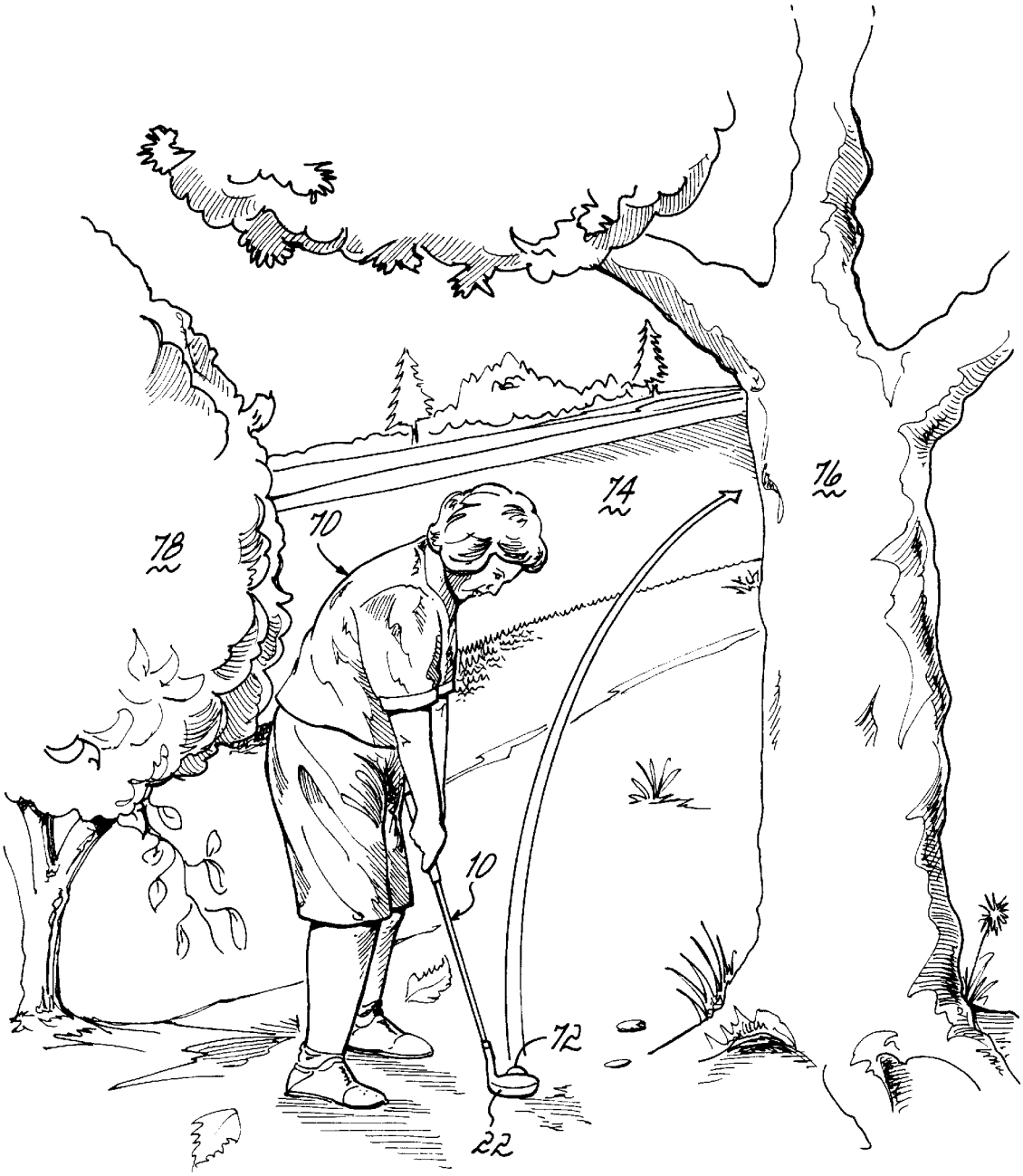
FIG. 9 is a perspective view of a golfer using the utility golf club of this invention to execute a trouble shot from among trees.

FIG. 7 illustrates a shot which may also be troublesome for the average golfer. Golfer 50 is shown located in a fairway 52 about to hit a golf ball 54 to a putting green 56. Golfer 50 may be located, for example, from about 10 to 100 yards from putting green 56. Within this distance range, the typical golfer may choose a lofted iron to fly the ball all the way to putting green 56, or may choose a less lofted iron to bump-and-run the shot to the putting green 56. These shot selections are error prone. Using golf club 10 with a conventional putting stroke, golf ball 54 may be more easily struck in a bump-and-run fashion than with conventional irons. The golfer will not have to rely on precise timing and precise swing movements as necessary when hitting the ball with an iron. Once struck with club 10, the ball will have a relatively low amount of air time and then roll in a predictable manner to the putting green 56. Due to the unique features of golf club 10, and the use of a familiar pendulum style putting stroke, there is less chance of error in the golfer's stroke. Moreover, even if the golfer's stroke is not optimal, solid contact with ball 54 is more likely with golf club 10 than with conventional clubs used for approaching a putting green. In this regard, for example, the weight of the club head and the significant surface area of the sole plate will prevent many types of typical mishits.

Figure 8:
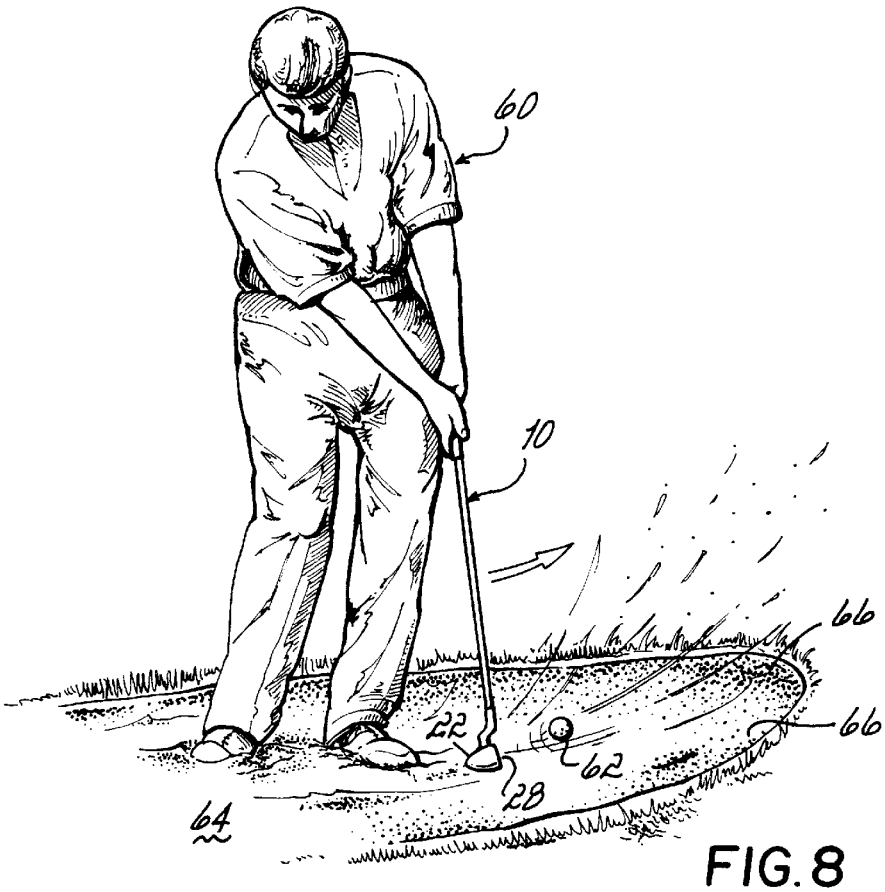
FIG. 8 is a perspective view of a golfer using the utility golf club of this invention in a sand trap.

FIG. 8 illustrates a golfer 60 striking a golf ball 62 from a sand trap 64. Many average golfers find shots from sand traps exceedingly difficult. Using golf club 10 of the present invention, at least in situations where sand trap 64 has a relatively low lip or edge 66 which must be cleared, golfer 60 may use a typical putting stroke to hit golf ball 62 out of sand trap 64. Because golf club 10 has a length and weight comparable to a putter, and because of the particular shape characteristics of head 22, club 10 may be more easily used in the depicted manner. Club head 22 will glide through and along the sand within sand trap 64 more readily than a typical sand wedge and, due to the lofted front face 28, will supply golf ball 62 with the lift necessary to carry it out of sand trap 64. The required lift may be controlled, for example, by adjusting the face angle $\alpha$ or by moving the ball forward or backward in the golfer's stance.

Finally, FIG., 9 illustrates a golfer 70 in a typical situation requiring execution of a so-called trouble shot. In this regard, the golfer's objective is generally to get the ball back into a more favorable position, ideally in a fairway 74. Often, this requires a low shot to avoid branches of trees 76, 78. Without the use of golf club 10, this may typically require golfer 70 to use a low lofted iron in an unfamiliar and unconventional manner. For example, golfers are typically instructed to grip down on a 2-iron or 3-iron, play the ball in the back of their stance and take a short swing. This unique set up and swing is difficult for the average golfer to recall and execute consistently. With golf club 10, golfer 70 may again assume a familiar putting stance and ball position and take a conventional putting stroke with the necessary amount of speed. This will result in a low ball flight and more likely result in achieving solid ball contact and the desired ball travel back into fairway 74.

While a preferred embodiment of the present invention has been detailed herein, those of ordinary skill will recognize many modifications, substitutions of components and departures from this detailed description which nevertheless fall within the spirit and scope of the invention as set forth in the appended claims.

I claim:

1. A utility golf club comprising:

a shaft having a first end and a second end defined along an axis, and a grip portion extending downwardly from the first end, and a head connected to the second end of the shaft, the head having a top surface, a bottom surface, a front face portion angled rearwardly from vertical with a face angle of at least about 10°, and a generally rounded periphery extending from the front face portion, the top and bottom surfaces each having a greater surface area than the front face portion, wherein the golf club has a length extending from the first end of the shaft to the bottom surface of the head with said length being less than about 39 inches, and wherein an angle generally formed between the bottom surface of the head and the shaft axis is greater than about 65°.

2. The utility golf club of claim 1, wherein the head includes a generally rounded top surface and a generally flat bottom surface.

3. The utility golf club of claim 1, wherein the head weighs more than about 9 grams.

4. The utility golf club claim 1, wherein the head includes a hosel portion connected to the second end of the shaft and the hosel portion includes an offset.

5. The utility golf club of claim 1, wherein the front face portion is angled from vertical in a range between about 16° and about 22°.

6. The utility golf club of claim 1, wherein the angle generally formed between the bottom surface of the metal head and the shaft axis is greater than about 70°.

7. The utility golf club of claim 1, wherein the length is about 35 inches.

8. The utility golf club of claim 1, wherein the head has a hollow metal construction.

9. The utility golf club of claim 1, wherein the top surface of the head is generally rounded and the bottom surface of the head includes a plurality of flat portions.

10. A utility golf club comprising:

a shaft having a first end and a second end defined along an axis and a grip portion extending downwardly from the first end, and a head connected to the second end of the shaft, the head having a front face portion angled rearwardly from vertical with a face angle of at least about 10° and a generally rounded periphery extending from the rearwardly angled front face portion, and having top and bottom surfaces extending between the generally rounded periphery with the top and bottom surfaces each having a greater surface area than the front face position, wherein the weight of the head is greater than about 230 grams, an angle generally formed between the bottom surface of the head and the shaft axis is greater than about 65° and the golf club has a length extending from the first end of the shaft to the bottom surface of the head of less than about 39 inches.

11. The utility golf club of claim 10, wherein the head has a hollow metal construction.

12. The utility golf club of claim 10, wherein the weight of the head is about 290 grams.

13. The utility golf club of claim 10, wherein the length is about 35 inches.

14. The utility golf club of claim 10, wherein the rearwardly angled front face portion is offset rearwardly with respect to the shaft axis.

15. The utility golf club of claim 10, wherein the head includes a hosel portion connected to the second end of the shaft and the hosel portion includes an offset.

16. The utility golf club of claim 10, wherein the front face portion is angled from vertical in a range between about 16° and about 22°.

17. The utility golf club of claim 10, wherein the angle generally formed between the bottom surface of the head and the shaft axis is greater than about 70°.

18. The utility golf club of claim 10, wherein the top surface of the head is generally rounded and the bottom surface of the head includes at least one generally flat portion.

19. A utility golf club comprising:

a shaft having a first end and a second end defined along an axis and a grip portion extending downwardly from the first end, and a head connected to the second end of the shaft, the head having a front face portion angled rearwardly from vertical at least about 10°, a rounded periphery extending from the rearwardly angled front face portion, and top and bottom surfaces each having a greater surface area than the front face portion, wherein the front face portion is offset rearwardly with respect to the shaft axis, and the golf club has a length extending from the first end of the shaft to the bottom surface of the head of less than about 39 inches and an angle generally formed between the bottom surface of the head and the shaft axis is greater than about 65°.

20. The utility golf club of claim 19, wherein the head has a weight greater than about 230 grams.

21. The utility golf club of claim 19, wherein the front face portion is angled from vertical in a range between about 16° and about 22°.

22. The utility golf club of claim 19, wherein the length is about 35 inches.

23. The utility golf club of claim 19, wherein the head has a hollow metal construction.

24. A utility golf club head comprising a top surface, a bottom surface, a front face portion angled rearwardly at least about 10°, and a generally rounded periphery extending from the front face portion, the top and bottom surfaces each having a greater surface area than the front face portion, the head including a shaft attachment opening defining an axis for a shaft to be inserted therein, said axis forming a lie angle generally with the bottom surface of the head of greater than about 65° and wherein the head weighs more than about 230 grams.

25. The utility golf club head of claim 24 further comprising a hosel extending upwardly from the top surface and including the shaft attachment opening therein.

26. The utility golf club head of claim 25, wherein the hosel includes an offset portion to offset the front face portion rearwardly relative to an upper portion of the hosel.

27. The utility golf club head of claim 24, wherein the club head weighs between about 230 grams and about 320 grams.

28. The utility golf club head of claim 24, wherein the lie angle is greater than about 70°.

* * * * *

UNITED STATES PATENT AND TRADEMARK OFFICE

CERTIFICATE OF CORRECTION

PATENT NO. : 6,033,320

DATED : March 7, 2000

INVENTOR(S) : Michael Bamberger

It is certified that error appears in the above-identified patent and that said Letters Patent is hereby corrected as shown below:

Column 1, line 49, change "wit the light" to --with regard to the light--.

Column 6, claim 3, line 14, change "9" to --290--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*